US005544612A

United States Patent [19]

Eymard

[11] Patent Number: 5,544,612

[45] Date of Patent: Aug. 13, 1996

[54] INFLATABLE BOAT OPERATING AS A CATAMARAN, AND HAVING IMPROVED STABILITY

[75] Inventor: Michel Eymard, Toulouse, France

[73] Assignee: Zodiac International, Issy-Les-Moulineaux, France

[21] Appl. No.: 498,387

[22] Filed: Jul. 5, 1995

[30] Foreign Application Priority Data

Apr. 14, 1995 [FR] France ..... 95 04549

[51] Int. Cl.[6] ..... B63B 7/00

[52] U.S. Cl. ..... 114/345; 440/66

[58] Field of Search ..... 114/345, 125, 114/56, 283; 440/38–42, 66; 441/66

[56] References Cited

U.S. PATENT DOCUMENTS

| | | | |
|---|---|---|---|
| 2,370,069 | 2/1945 | Patten . | |
| 4,082,049 | 4/1978 | Nicol | 114/345 |
| 4,231,131 | 11/1980 | Young | 114/345 |
| 4,528,927 | 7/1985 | Iizuka et al. | 114/345 |
| 5,259,331 | 11/1993 | Hagan | 440/66 |

FOREIGN PATENT DOCUMENTS

| | | | |
|---|---|---|---|
| 2093657 | 1/1972 | France . | |
| 2235038 | 1/1975 | France | 114/345 |
| 2464178 | 3/1981 | France . | |
| 2504881 | 11/1982 | France . | |
| 2051835 | 4/1972 | Germany | 114/345 |
| 616373 | 3/1980 | Switzerland . | |
| 0575615 | 2/1946 | United Kingdom | 114/345 |
| 1319072 | 5/1973 | United Kingdom . | |
| 2001586 | 7/1977 | United Kingdom . | |
| 2077207 | 6/1980 | United Kingdom . | |

*Primary Examiner*—Edwin L. Swinehart
*Attorney, Agent, or Firm*—Larson and Taylor

[57] ABSTRACT

An inflatable boat (1) includes at least one inflatable buoyancy tube (2) forming two substantially parallel branches (3) that are united towards the forward end (4). A bottom (5) that is rigid in the transverse direction is held between the two branches (3) of the inflatable tube (2). A transom (6) is provided for supporting an outboard motor assembly. The boat is characterized in that the stern portion of the underside of its bottom (5) supports at least one projecting bulb (7) that is elongate in the longitudinal direction of the boat and that is constituted by a flexible bag which is inflated by a fluid under pressure. This bulb (4) is disposed facing the position occupied by an arm of the motor assembly that plunges into the water and that supports at least one thrust member together with anticavitation plates.

15 Claims, 3 Drawing Sheets

INFLATABLE BOAT OPERATING AS A CATAMARAN, AND HAVING IMPROVED STABILITY

FIELD OF THE INVENTION

The present invention relates to improvements relating to inflatable boats comprising at least one inflatable buoyancy tube forming two substantially parallel branches that are united towards the forward end; a bottom that is rigid in the transverse direction and that is held between said two branches of the inflatable tube; and a transom for supporting an outboard motor assembly.

BACKGROUND OF THE INVENTION

Boats made as mentioned above do not have a central keel, and when they are propelled at high speed they plane, thereby causing them to be supported on the water solely via the rear portions of the two branches of the tube. Under such circumstances, they behave like catamarans.

A disadvantageous feature of such catamarans lies in the absence of guidance for liquid flow beneath the central portion of the boat, specifically where the arm of the outboard motor assembly plunges into the water. As a result the flow of water at this location is highly unstable and it is practically impossible to position appropriately the anticavitation plates that are fixed to the arm of the motor assembly above the thrust member(s).

SUMMARY OF THE INVENTION

It is therefore desirable for boats of the above type that operate as catamarans when planing and that do not have any central hull should be improved in such a manner that the hydrodynamic conditions at the arm of the motor assembly are stabilized and made analogous to those that are provided by a traditional V-shaped central hull, so that the anticavitation plates are located in conditions for optimum operation and so that the thrust member is appropriately fed.

To these ends, the present invention proposes an inflatable boat as mentioned in the preamble, and which is essentially characterized in that the stern portion of the underside of its bottom supports at least one projecting bulb that is elongate in the longitudinal direction of the boat and that is constituted by a flexible bag which is inflated by a fluid under pressure, said bulb being disposed facing the position occupied by an arm of the motor assembly that plunges into the water and that supports at least one thrust member together with anticavitation plates.

The bulb provided by the invention is thus located immediately above and ahead of the thrust member (a propeller or a ducted turbine), so as to guide the flow of liquid and recreate hydrodynamic conditions analogous to those generated by a traditional V-shaped hull in order to enable the anticavitation plates above the thrust member to be capable of being positioned in stable manner and to enable the thrust member to be capable of being fed properly for optimum operation. It may be observed here that the bulb does not constitute a keel and does not perform any guidance, ballast, or static or dynamic stabilizing function of the kind provided by a conventional central hull or keel.

It may also be observed that the bulb does not become functional until the boat is travelling at high speed and is planing. As a result, there is no point in it being present while the boat is travelling slowly, without planing, in which case the boat behaves like a traditional displacement hull. Under such conditions, it is advantageous to make provision for the projecting bulb to be hydrodynamically inflated by means of a water inlet orifice that is open forwardly so that the bulb becomes inflated only when the boat has reached a certain speed so it is planing and operating like a catamaran.

In the common case of a boat fitted with a motor assembly having a single arm, there is only one bulb and it is disposed centrally on the axis of the bottom.

In an embodiment that is preferred because it is simple to manufacture, the general shape of the bulb is approximately a circular cylinder with a tapering leading end.

In practice, the longitudinal extent of the bulb does not exceed about one-fourth of the length of the boat, and it is preferably about 1 meter long.

As already mentioned above, the bulb of the invention does not constitute a traditional keel and is therefore incapable of providing any guidance, ballast, or static or dynamic stabilizing function as would be imparted by a traditional keel. In particular, the boat therefore retains the poor load-carrying capacity of catamarans.

To remedy this drawback, at least in part, the invention provides for improving water flow guidance by implementing two substantially rigid and parallel skirts on the outsides of respective branches of the inflatable tube, which skirts are substantially rigid and parallel, and extend vertically well below said branches. The two skirts preferably have a vertical extent that exceeds that of the branches of the inflatable tube by at least 10% of the diameter thereof.

Because of the presence of these skirts, the roll stability of the boat fitted in this way is caused to be mediocre, and it runs the risk of capsizing while turning. It is therefore desirable to provide, a stabilizing inflatable tube on each side of the boat and located above each corresponding branch of the buoyancy tube and while also projecting laterally outwards beyond it. Advantageously, each stabilizing tube is larger in diameter than the buoyancy tube. It is then advantageous, in order to fix the above-mentioned skirts securely, for each skirt to be fixed, via its top longitudinal edge, to the corresponding stabilizing tube, and for it to be fixed laterally to the corresponding branch of the buoyancy tube along the outermost generator line thereof. Also preferably, the ends of the transom are fixed to the stabilizer tubes; still preferably, the bottom comprises an inflatable plane panel which rests via its longitudinal edges on the branches of the buoyancy tube.

During manufacture, it is then advantageous for the boat to be made by uniting two subassemblies that have been preassembled separately: a first subassembly being constituted by the buoyancy tube provided with the lateral skirts and having the longitudinal edges of the bottom resting thereon; and a second subassembly constituted by the two stabilizer tubes that are united at their stern ends by the transom.

BRIEF DESCRIPTION OF THE DRAWINGS

The invention will be better understood on reading the following detailed description of a preferred embodiment given solely by way of non-limiting example. In the description, reference is made to the accompanying drawings, in which.

DESCRIPTION OF THE PREFERRED EMBODIMENTS

Figure 1:
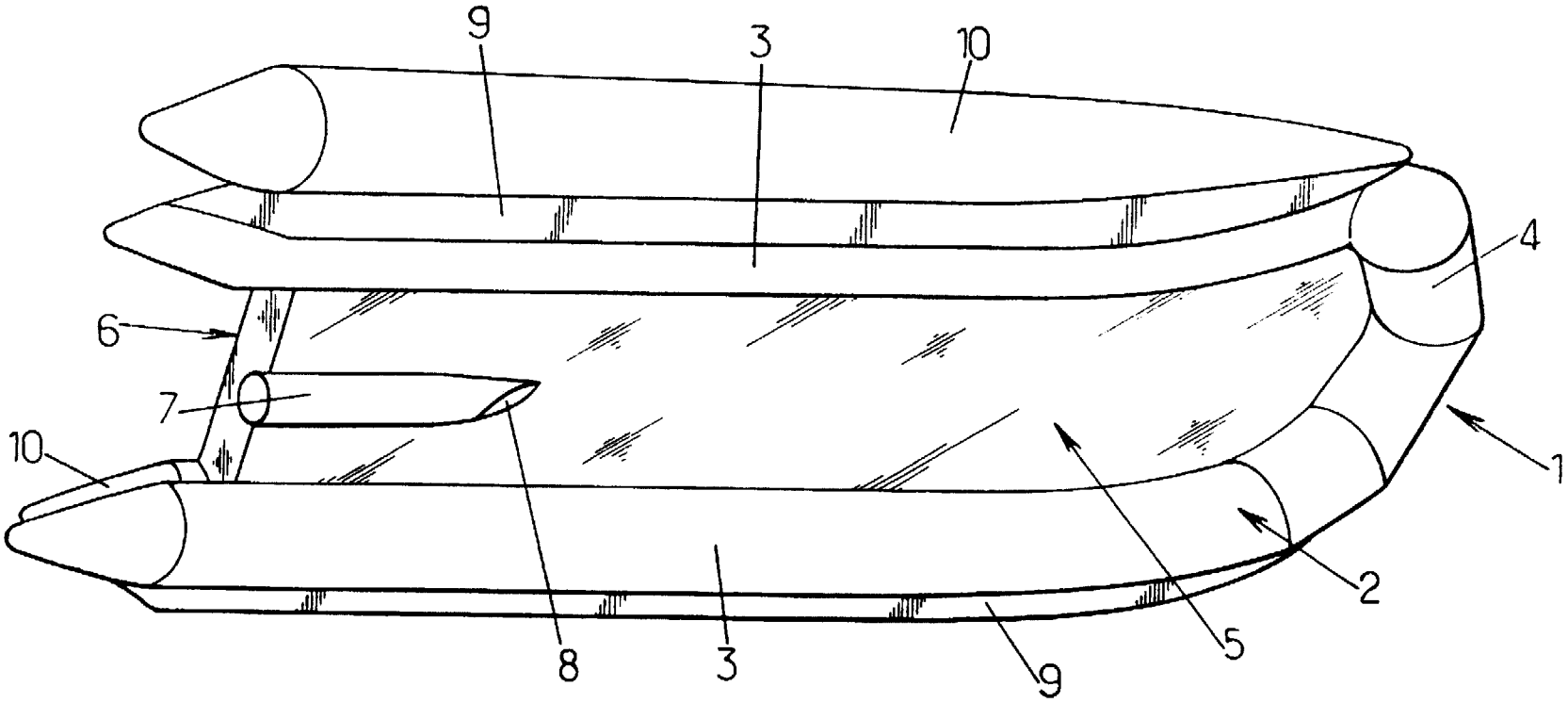
FIG. 1 is a diagrammatic perspective view from below of a boat made in accordance with the invention.

As shown in the drawings, the inflatable boat of the invention given overall numerical reference 1 comprises an inflatable buoyancy tube 2 forming two substantially parallel branches 3 that meet at the forward end 4. The tube is turned up significantly at the forward end to prevent the boat being braked by striking the waves. In addition, the diameter of the inflatable tube is preferably as small as possible while still being large enough to be compatible with the non-breaking amplitude of a wave of length approximately equal to the length of the boat.

A bottom 5 is also provided which is rigid in the transverse direction and which is held between the two above-mentioned branches of the inflatable tube 2 and which serves to space them apart. The bottom 5 advantageously comprises a plane panel that can be inflated under relatively high pressure, and it is secured, in particular by adhesive, to the top of the buoyancy tube. The width of the bottom is kept down to the minimum necessary to allow it to rest via its longitudinal edges on the tube 2 and to enable it to carry loads without sagging significantly.

Finally, a rigid transom 6 is also provided which extends transversely at the stern of the boat, being connected to the bottom 5 by a watertight flexible hinge. It is fitted to support an outboard motor assembly (not shown) having a long arm, with anticavitation plates situated 20 cm to 25 cm beneath the bottom of the transom 6.

To guide liquid flow in the vicinity of the (or each) arm of the motor assembly towards the anticavitation plates and to keep said anticavitation plates in optimum operating conditions so as to cause the thrust members to be fed properly, provision is made beneath the stern end of the bottom 5 for at least one projecting bulb 7 that is elongate in the longitudinal direction of the boat and that is constituted by a flexible bag which is inflated by a fluid under pressure. The bulb 7 is fixed, e.g. by adhesive, to the bottom face of the bottom 5 and it is disposed facing the position occupied by an arm of the motor assembly that plunges into the water and supports at least one thrust member (propeller or ducted turbine), together with the anticavitation plates situated thereabove. In the common case of only one arm that is disposed centrally, there is likewise only one bulb 7 which is disposed centrally.

The general shape of the bulb 7 is approximately that of a circular cylinder with a tapering forward end. Its longitudinal extent does not exceed one-fourth of the length of the boat, and in practice it seems that a bulb having a length of about 1 meter is suitable.

At slow speed, the boat behaves like a traditional displacement hull and the presence of the projecting bulb is functionally unnecessary. The effectiveness of the bulb 7 appears only when the boat is moving at high speed and planing so that it is behaving like a catamaran. Under such conditions, it is advantageous for the bulb to be implemented in the form of a hydrodynamically-inflated bag which is provided with a water inlet orifice 8 that is open at its front end. A hydrodynamic keel for an inflatable boat is described and shown in document FR 2 633 581, and the bulb 7 may be constituted in analogous manner, even though the bulb 7 does not constitute a keel in the usual meaning of the term, and in particular it does not provide the guidance, ballast, and static or dynamic stabilizing functions that are normally provided by a keel.

Nevertheless, once planing the boat made as described above still presents poor ability in guiding water flow and poor capacity to carry a load. To remedy this drawback, at least in part, provision is made to fit the branches 3 of the buoyancy tube 2 with stability strakes constituted by two substantially rigid and parallel skirts 9 secured to the outsides of the branches 3 along the outermost generator lines thereof, and extending substantially vertically, to well below said branches 3 of the buoyancy tube 2. In practice, the two skirts 9 extend vertically downwards below said branches 3 by at least 10% of the diameter thereof. Each skirt is advantageously constituted by a flat and watertight flexible bag having a plate of relatively rigid material received therein; in practice it may comprise a set of plates placed side by side and secured to one another.

With a boat fitted in this way, roll stability is relatively poor, and the boat runs the risk of capsizing while turning. To mitigate this drawback, stabilizers are provided at the top of the boat, i.e. out of the water when travelling in a straight line. To this end, two stabilizing tubes 10 of large diameter (greater than that of the buoyancy tube 2) are disposed on top of respective branches 3 of the buoyancy tube 2, the stabilizer tubes also project a considerable distance and laterally outwards beyond the branches 3. The ends of the transom 6 are secured to the stabilizer tubes 10. In addition to their primary function of stabilizing the boat while turning, the stabilizer tubes 10 also constitute sides providing the necessary freeboard and also providing mechanical strength for taking up the thrust forces from the motor assembly via the transom 6. The stabilizing tubes are fitted with conventional boat accessories such as handles, foot ropes, . . . .

Figure 3:
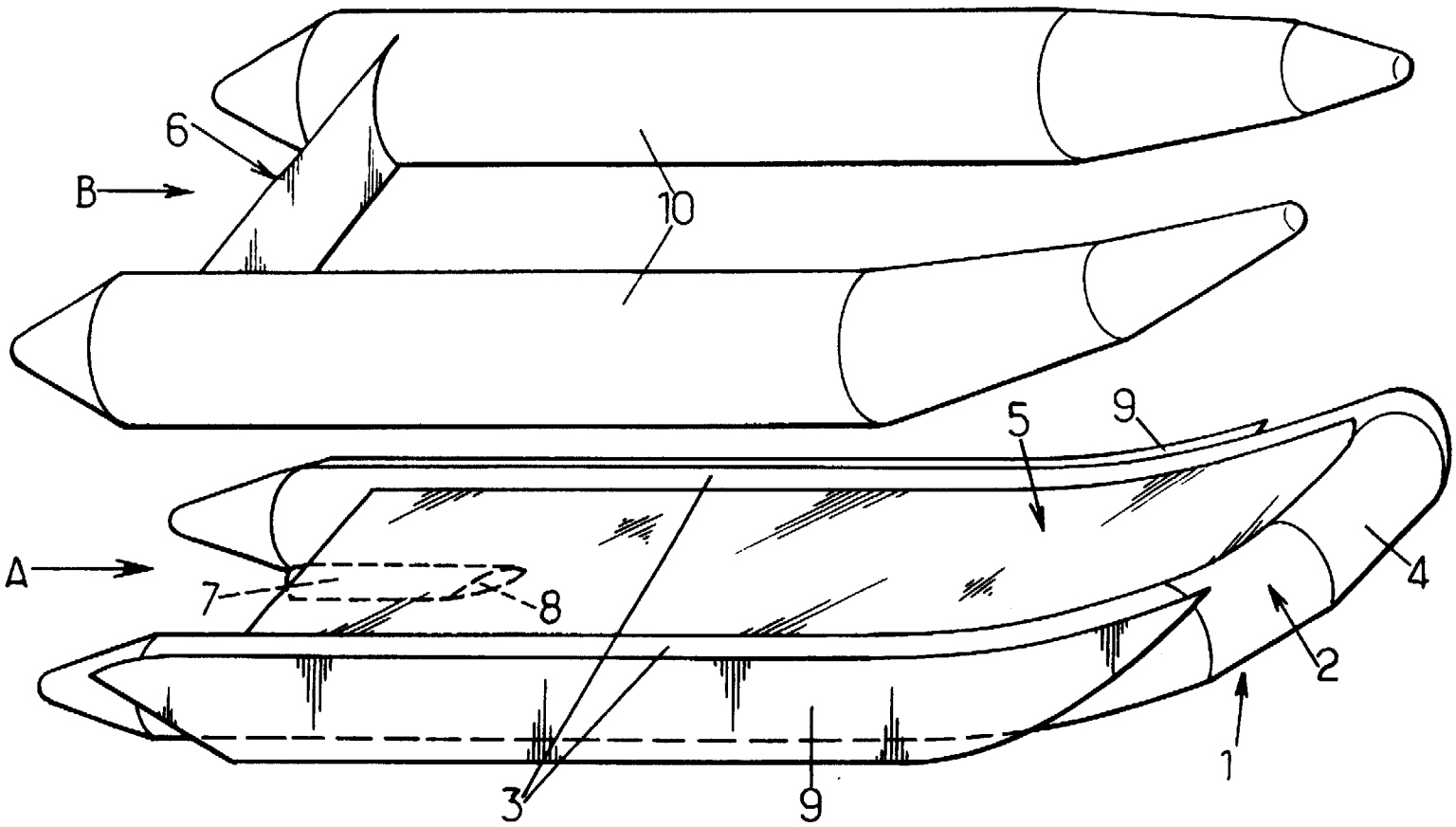
FIG. 3 is an exploded diagrammatic side view in perspective showing the boat of FIGS. 1 and 2 and illustrating one way of building the boat.

As can be seen more particularly in FIG. 3, which is an exploded view of the boat 1, the boat may be built by uniting two superposed subassemblies that have been preassembled separately: a first subassembly A is constituted by the inflatable buoyancy tube 2 with its two parallel branches 3 to which the vertical skirts 9 are secured tangentially and on which the bottom 5 rests, and is secured via its longitudinal edges; and a second subassembly B constituted by the two stabilizing tubes 10 that are united towards their stern ends by the transom 6.

The stabilizer tubes 10 are fixed on the parallel branches 3 of the buoyancy tube 2 by two longitudinal connections that may be of any kind, but at least one of which must be waterproof. The bottom 5 then extends level with this connection.

Figure 2:
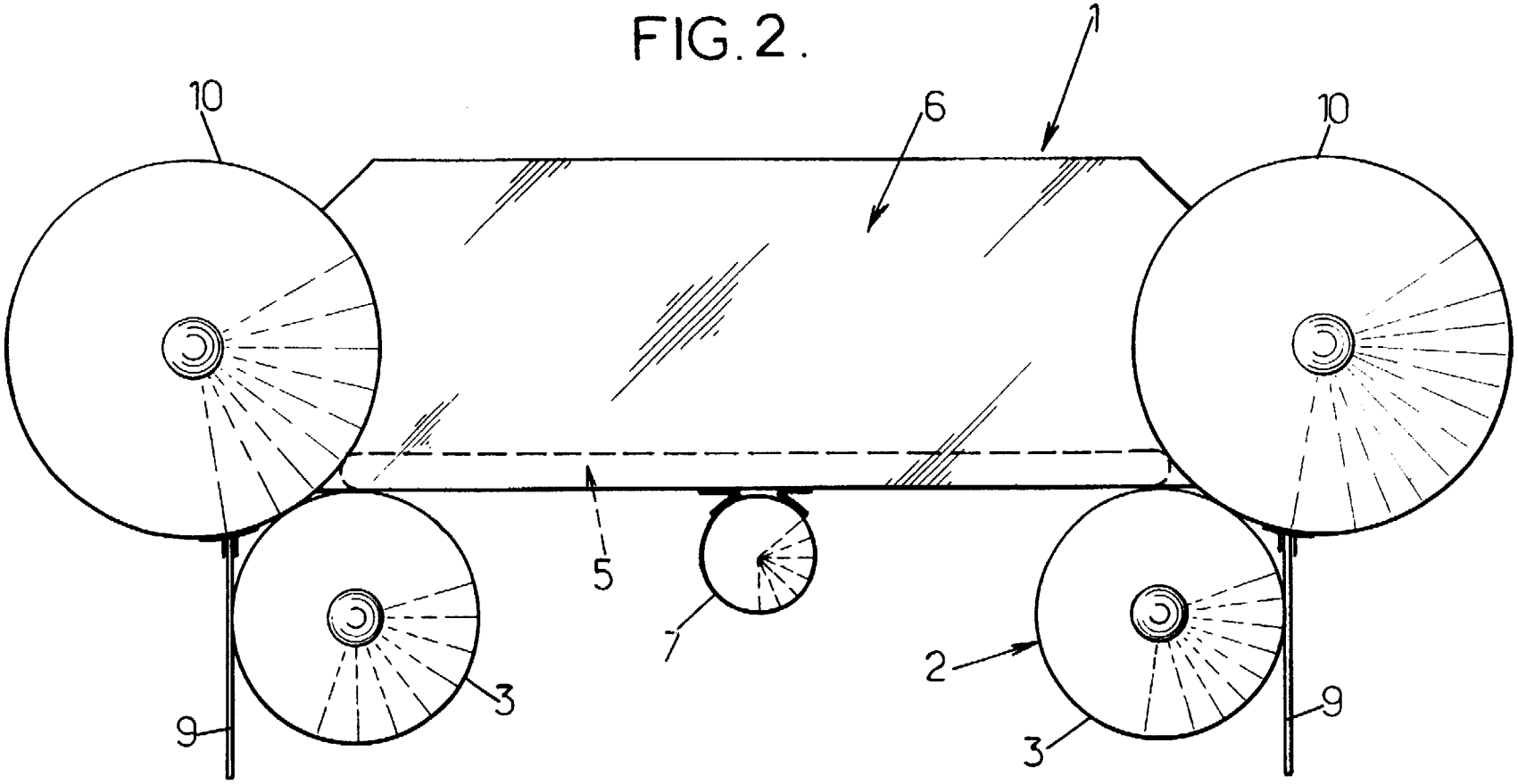
FIG. 2 is a diagrammatic stern view of the FIG. 1 boat.

In addition, to ensure that the vertical skirts 9 are securely fixed, provision is made, as shown in FIG. 2, for them to be secured not only tangentially to the branches 3, but also via their top edges to the respective stabilizer tubes 10, e.g. by adhesive.

Naturally, and as can be seen from the above, the invention is not limited in any way to those applications and embodiments that have been more particularly described; on the contrary, it extends to any variants.

I claim:

1. An inflatable boat (1) comprising at least one inflatable buoyancy tube (2) forming two substantially parallel branches (3) that are united towards the forward end (4); a bottom (5) that is rigid in the transverse direction and that is held between said two branches (3) of the inflatable tube (2); and a transom (6) at the stern used for supporting an outboard motor assembly; the boat being characterized in that at least one projecting bulb (7) is provided only in the stern of the underside of its bottom (5) and projecting therefrom, said at least one projecting bulb (7) being elongate in the longitudinal direction of the boat and being constituted by a flexible bag which is inflated by a fluid under pressure, said bulb (4) being disposed facing a position which is occupied by an arm of the motor assembly adapted to be supported by said transom which arm plunges into the water and which arm supports at least one thrust member together with anticavitation plates.

2. A boat according to claim 1, characterized in that the projecting bulb (7) is hydrodynamically inflatable and possesses an inlet orifice (8) that is forwardly open.

3. A boat according to claim 1, characterized in that it has a single bulb (7) which is disposed centrally to be used with a motor assembly having a single arm disposed centrally.

4. A boat according to claim 1, characterized in that the general shape of the bulb (7) is approximately a circular cylinder having a tapering forward end.

5. A boat according to claim 1, characterized in that the bulb (7) has a longitudinal extent of not more than about one-fourth of the length of the boat.

6. A boat according to claim 5, characterized in that the bulb is about 1 meter long.

7. A boat according to claim 1, characterized in that it includes two skirts (9) respectively on the outsides of the branches (3) of the inflatable tube (2), the skirts being substantially rigid and parallel and extending substantially vertically well beneath the branches (3).

8. A boat according to claim 7, characterized in that the vertical extent of the two skirts (9) exceeds that of the branches (3) of the inflatable tube (2) by at least 10% of the diameter thereof.

9. A boat according to claim 7, characterized in that each skirt (9) is constituted by a flat and flexible bag containing at least one plate of relatively rigid material.

10. A boat according to claim 1, characterized in that it includes two skirts (9) respectively on the outsides of the branches (3) of the inflatable tube (2), the skirts being substantially rigid and parallel and extending substantially vertically well beneath the branches (3); and in that each side of the boat further includes a stabilizing inflatable tube (10) disposed above the corresponding branch of the buoyancy tube (2) and projecting laterally outwards beyond said branch.

11. A boat according to claim 10, characterized in that each stabilizer tube (10) has a diameter greater than the diameter of the buoyancy tube.

12. A boat according to claim 10, characterized in that on each side the skirt (10) is fixed along its top longitudinal edge to the corresponding stabilizer tube (10) and laterally to the corresponding branch (3) of the buoyancy tube (2) along the outermost generator line thereof.

13. A boat according to claims 10, characterized in that the ends of the transom (6) are fixed to the stabilizer tubes (10).

14. A boat according to claim 1, characterized in that the bottom (5) comprises an inflatable flat panel whose longitudinal edges rest on the two branches (13) of the buoyancy tube (2).

15. A boat according to claim 10, characterized in that it is built by uniting two separately preassembled subassemblies one on the other, namely:

a first subassembly (A) constituted by the buoyancy tube (2) provided with the side skirts (9) and having the bottom (5) resting thereon via its longitudinal edges; and a second subassembly (B) constituted by the two stabilizer tubes (10) united towards the stern by the transom (6).

* * * * *